US007711305B2

(12) United States Patent
Matsumoto

(10) Patent No.: US 7,711,305 B2
(45) Date of Patent: May 4, 2010

(54) FIXING DEVICE, FIXING BELT, AND IMAGE FORMING APPARATUS

(75) Inventor: Hiroshi Matsumoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1 day.

(21) Appl. No.: 12/157,294

(22) Filed: Jun. 9, 2008

(65) Prior Publication Data

US 2009/0010686 A1 Jan. 8, 2009

(30) Foreign Application Priority Data

Jul. 3, 2007 (JP) ..... 2007-174938

(51) Int. Cl.
*G03G 15/20* (2006.01)

(52) U.S. Cl. ..... 399/329; 399/320; 399/333

(58) Field of Classification Search ..... 399/320
See application file for complete search history.

(56) References Cited

U.S. PATENT DOCUMENTS

2002/0146259 A1* 10/2002 Zhou et al. ..... 399/329
2004/0131401 A1 7/2004 Nakatogawa
2007/0071514 A1 3/2007 Yagi et al.

FOREIGN PATENT DOCUMENTS

JP 2004-198655 A 7/2004
JP 2004-206105 A 7/2004
JP 2005-173441 A 6/2005

* cited by examiner

*Primary Examiner*—David M Gray
*Assistant Examiner*—Roy Yi
(74) *Attorney, Agent, or Firm*—Frishauf, Holtz, Goodman & Chick, P.C.

(57) ABSTRACT

A fixing device including: a fixing roller; an endless fixing belt which rotates with the fixing roller; a pressure member; a sliding sheet placed between the fixing belt and the pressure member; and a lubricating agent supplying section, a toner image being fixed onto a recording media at a nip portion formed between the fixing roller and the fixing belt, wherein the inner peripheral surface of the fixing belt and a surface of the sliding sheet are formed of polytetrafluoroethylene, wherein the following relation is satisfied: H1≦H2, where H1 is a surface hardness of the inner peripheral surface of the fixing belt and H2 is a surface hardness of the sliding sheet facing to the fixing belt.

8 Claims, 2 Drawing Sheets

FIXING DEVICE, FIXING BELT, AND IMAGE FORMING APPARATUS

RELATED APPLICATION

This application is based on Japanese Patent Application NO. 2007-174938 filed on Jul. 03, 2007 in Japanese Patent Office, the entire content of which is hereby incorporated by reference.

TECHNICAL FIELD

The present invention relates to fixing devices of the FBNF (Free Belt Nip Fuser) method having a fixing belt, to fixing belts used in such fixing devices, and to image forming apparatuses having such fixing devices.

BACKGROUND OF THE INVENTION

In image forming apparatuses of the electro-photographic method such as copying machines, printers, facsimiles, and multifunction peripherals provided with all these functions, a latent image corresponding to the original is formed on a photoreceptor drum, this latent image is made visible by giving toners to it, this visible toner image is transferred onto a recording material, and after that, the toner image on the recording material is fixed and then the recording material is discharged to outside the apparatus.

Further, in the case of forming color images, latent images of colors Y, M, C, and K corresponding to the colors of the original are formed on four photoreceptor drums, the toner images of four colors made visible are primary-transferred on to an endless intermediate belt, then they are secondary-transferred on to a recording medium, then toner image transferred on to the recording medium is fixed, and then the recording material is discharged to outside the apparatus.

As a fixing device for fixing such toner images is present a fixing device of the heated roller method that applies heat and pressure by gripping and conveying the recording medium with the toner image transferred on to it in a nip portion formed by a fixing roller having inside it a heating member such as a halogen lamp, etc., and a pressure roller that applies pressure on the fixing roller, and such a fixing device is being used widely because its construction is simple.

However, in such a fixing device, in order to achieve high speed it is necessary to supply sufficient amount of heat to the toner and the recording medium, and to do this it is necessary to increase the nip width. In order to increase the nip width, it is possible to consider increasing the load with which the pressure roller presses the fixing roller, the thickness of the elastic layer formed from silicone rubber, etc., inside the pressure roller, or the diameters of the two rollers, etc.

However, if the load or the thickness of the elastic layer of the pressure roller is increased, the nip width along the axial direction may sometimes become uneven, and there is the possibility of uneven fixing or wrinkles of the recording material occurring. Further, if the roller diameters are increased, there is the problem that not only the fixing device becomes big but also the warming up time becomes long.

In order to solve this problem, a fixing device of the so-called FBNF method has been disclosed in the Unexamined Japanese Patent Application Publications (see publication No. 2005-173441, No. 2004-198655, and No. 2004-206105), wherein the fixing device is provided with a fixing roller having an elastic layer made of silicone rubber and a heating member such as a halogen lamp, etc., built in at the center and rotating, an endless fixing belt that rotates being driven by the fixing roller, a pressure pad that presses against the fixing roller via the fixing belt from the inside of the fixing belt, and a low friction sliding sheet placed between the fixing belt and the pressure pad, and in the nip portion formed by the fixing roller and the fixing belt, the recording material on to which the toner image has been transferred is heated and pressed while being gripped and conveyed.

According to this fixing device, the fixing belt pressed to the fixing roller by the pressure pad deforms elastically, and a wide nip section is formed between the fixing roller and the fixing belt. Consequently, it is possible to achieve high speeds, and also the fixing device does not become big. In addition, since the thermal capacity of the fixing belt is small, the warming up time becomes short and it is possible to save energy.

Further, although in Unexamined Japanese Patent Application Publication No. 2005-173441 the sliding resistance is being reduced by supplying lubricating agent between the fixing belt and pressure pad in a fixing device of the FBNF method, since the lubricating agent is not retained in a stable manner, a surface roughness of Ra=0.3 to 1.6 μm is formed on the inner peripheral surface of the fixing belt thereby increasing the lubricating agent retention capacity. Further, polytetrafluoroethylene (hereinafter called PTFE) has been disclosed as the material of the releasing layer coated on the surface of the fixing belt, and PTFE has also been disclosed as the material of the sliding sheet.

In Unexamined Japanese Patent Application Publication No. 2004-198655, similar to Unexamined Japanese Patent Application Publication No. 2005-173441, in order to increase the lubricating agent retention capacity, the surface contacting with the fixing belt in the sliding sheet (pad cap) has been made a rough surface. It is desirable that the surface roughness of the undulating surface is Ra=0.5 to 10 μm. Further, PFA has been disclosed as the material of the releasing layer of the fixing belt, and PES (polyester sulfone), etc., have been disclosed as the material of the sliding sheet.

In Unexamined Japanese Patent Application Publication No. 2004-206105, although the conventional sliding sheet is formed to be porous in order to retain the lubricating agent, since it cannot withstand use for a long time, the sliding surface of the sliding sheet is made porous and to include a fluoroplastic. In addition, even PTFE has been disclosed as the material of the releasing layer of the fixing belt and also PTFE has been disclosed as the material of the sliding sheet.

As has been disclosed in Unexamined Japanese Patent Application Publication No. 2005-173441, Unexamined Japanese Patent Application Publication No. 2004-198655, and in Unexamined Japanese Patent Application Publication No. 2004-206105, in a fixing device of the FBNF method, because of placing a sliding sheet between the fixing belt and the pressure pad, the sliding resistance of the rotating fixing belt has been reduced since the fixing belt and the pressure pad do not come into direct contact with each other. In addition, reducing the sliding resistance is also made by supplying a lubricating agent between the fixing belt and the sliding sheet.

However, since the fixing belt is in sliding contact with the sliding sheet, there is a certain amount of sliding resistance and at least some abrasion is caused in both of them. In addition, although it is necessary to retain the lubricating agent definitely in the nip portion, conventionally it was not sufficient to prevent the abrasion and an efficiency to retain the lubricant was deteriorated through a long time usage.

An object of the present invention is to solve the above mentioned problem.

SUMMARY

One aspect of the present invention is a fixing device including:

a fixing roller which has an elastic layer and a internal heating member and rotates;

an endless fixing belt which rotates with the fixing roller;

a pressure member which presses the fixing belt against the fixing roller from an inner peripheral surface side of the fixing belt;

a sliding sheet placed between the fixing belt and the pressure member; and a lubricating agent supplying section which supplies a lubricating agent to the inner peripheral surface of the fixing belt, a toner image being fixed onto a recording media at a nip portion formed between the fixing roller and the fixing belt, wherein the inner peripheral surface of the fixing belt and a surface of the sliding sheet are formed of polytetrafluoroethylene, wherein the following relation is satisfied:

$H1 \leqq H2$, where H1 is a surface hardness of the inner peripheral surface of the fixing belt and H2 is a surface hardness of the sliding sheet facing to the fixing belt.

And another aspect of the present invention is a fixing device including:

a fixing roller which has an elastic layer and a internal heating member and rotates;

an endless fixing belt which rotates with the fixing roller;

a pressure member which presses the fixing roller against the fixing belt from an inner peripheral surface side of the fixing belt;

a sliding sheet placed between the fixing belt and the pressure member; and a lubricating agent supplying section which supplies a lubricating agent to the inner peripheral surface of the fixing belt, a toner image being fixed onto a recording media at a nip portion formed between the fixing roller and the fixing belt, wherein the inner peripheral surface of the fixing belt and a surface of the sliding sheet are formed of polytetrafluoroethylene, wherein the following relation is satisfied:

$Ra1 \geqq Ra2$, where Ra1 is a surface roughness of the inner peripheral surface of the fixing belt and Ra2 is a surface roughness of the sliding sheet facing to the fixing belt.

DESCRIPTION OF THE PREFERRED EMBODIMENT

Figure 1:
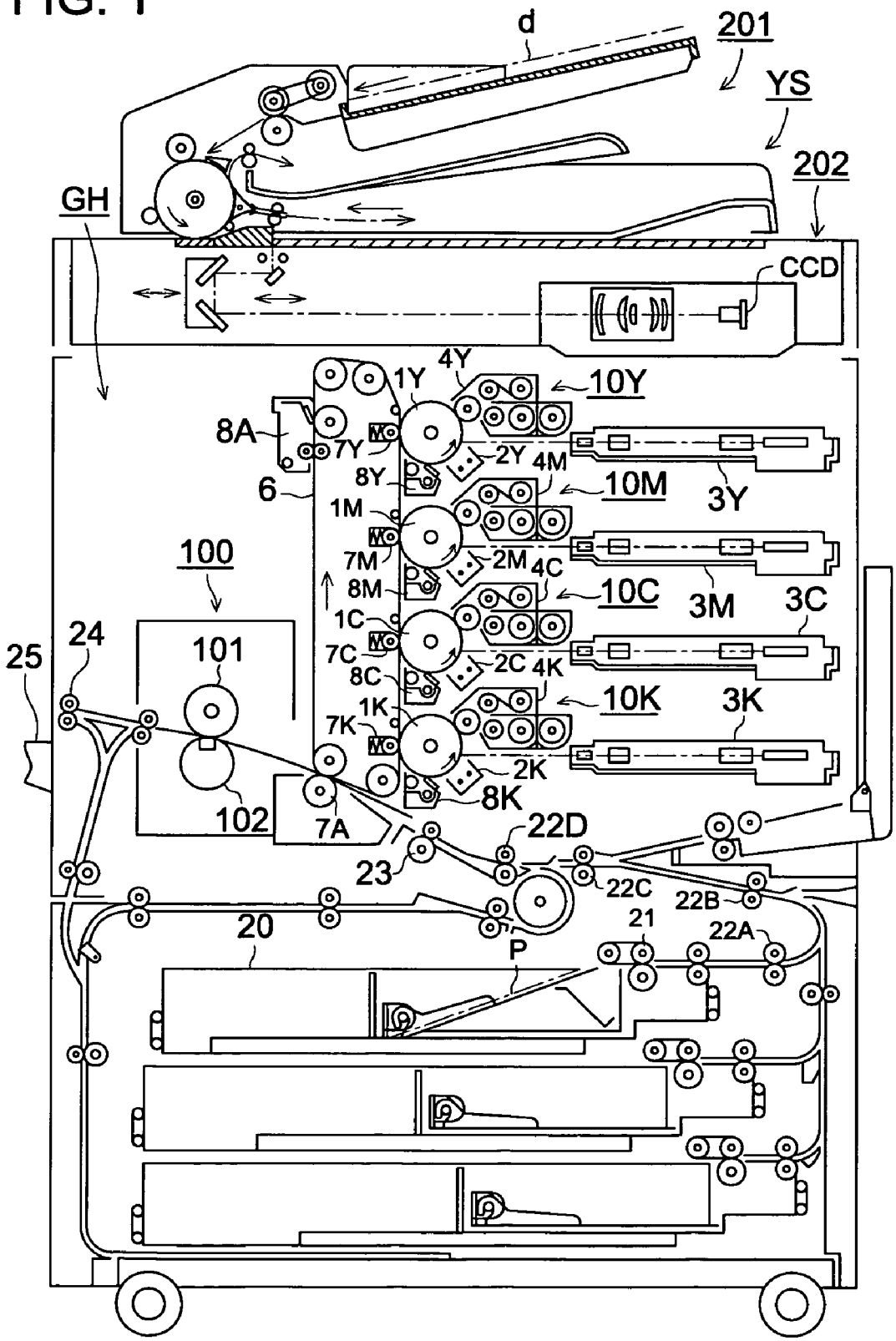
FIG. 1 is a configuration diagram of an image forming apparatus.

A preferred embodiment of a fixing device of the present invention is described below referring to the drawings.

To begin with, an example of an image forming apparatus using a fixing device of the present invention is described based on the configuration diagram of FIG. 1.

The present image forming apparatus comprises an image forming apparatus main unit GH and an image reading apparatus YS.

The image forming apparatus main unit GH is one that is called a tandem type color image forming apparatus and has a plurality of image forming section 10Y, 10M, 10C, and 10K, a belt shaped intermediate image transfer belt 6, a sheet conveying section, a fixing device 9, etc.

Above the top part of the image forming apparatus main unit GH is placed an image reading apparatus YS made of an automatic document feeding apparatus 201 and a document image scanning exposure apparatus 202. A document d placed on the document table of the automatic document feeding apparatus 201 is conveyed by a conveying section, the image on one side or both sides of the document is scanned and exposed by the optical system of the document image scanning exposure apparatus 202, and is read out by the line image sensor CCD.

The signal formed by photoelectric conversion by the line image sensor CCD is subjected to analog processing, A/D conversion, shading correction, image compression processing, etc., in the image processing section, and is then sent to the exposure sections 3Y, 3M, 3C, and 3K.

The image forming section 10Y that forms images of yellow (Y) color has a charging section 2Y, an exposing section 3Y, a developing section 4Y, and a cleaning section 8Y placed around the photoreceptor drum 1Y. The image forming section 10M that forms images of magenta (M) color has a charging section 2M, an exposing section 3M, a developing section 4M, and a cleaning section 8M placed around the photoreceptor drum 1M. The image forming section 10C that forms images of cyan (C) color has a charging section 2C, an exposing section 3C, a developing section 4C, and a cleaning section 8C placed around the photoreceptor drum 1C. The image forming section 10K that forms images of black (K) color has a charging section 2K, an exposing section 3K, a developing section 4K, and a cleaning section 8K placed around the photoreceptor drum 1K. Further, the charging section 2Y and the exposing section 3Y, the charging section 2M and the exposing section 3M, the charging section 2C and the exposing section 3C, the charging section 2K and the exposing section 3K respectively constitute latent image forming sections.

Further, the developing sections 4Y, 4M, 4C, and 4K contain two-component developing agents having a carrier and a small particle diameter toner of colors yellow (Y), magenta (M), cyan (C), and black (K).

The intermediate image transfer member 6 is wound around a plurality of rollers and is supported in a rotatable manner.

The fixing device 100 fixes the toner image on the recording sheet (the recording material) P by applying heat and pressure in the nip portion formed between the heated fixing roller 101 and the fixing belt 102.

Thus, the images of different colors formed by the image forming sections 10Y, 10M, 10C, and 10K are successively transferred (primary transfer) by the transfer sections 7Y, 7M, 7C, and 7K on to the rotating intermediate image transfer member 6, thereby forming a toner image in which a color image is synthesized. The recording sheet P stored inside the sheet feeding cassette is fed by the sheet feeding section 21, passes over the sheet feeding rollers 22A, 22B, 22C, 22D, and the registration roller 23, etc., is conveyed to the transfer section 7A, and the color image is transferred onto the recording sheet P (secondary transfer). The recording sheet P on to which a color image has been transferred is subjected to heat and pressure in the fixing device 100 thereby fixing the color toner image on the recording sheet P. Thereafter, it is gripped by the sheet discharge roller 24 and is placed on the sheet discharge tray 25 outside the equipment.

On the other hand, after the color image is transferred by the transfer section 7A on to the recording sheet P, the intermediate image transfer member 6 from which the recording sheet P has been separated by bending has residual toner on it removed by the cleaning section 8A.

Further, although the above was an image forming apparatus that forms color images, it can also be an image forming apparatus that forms monochrome images, and the intermediate image transfer member may or may not be used.

Figure 2:
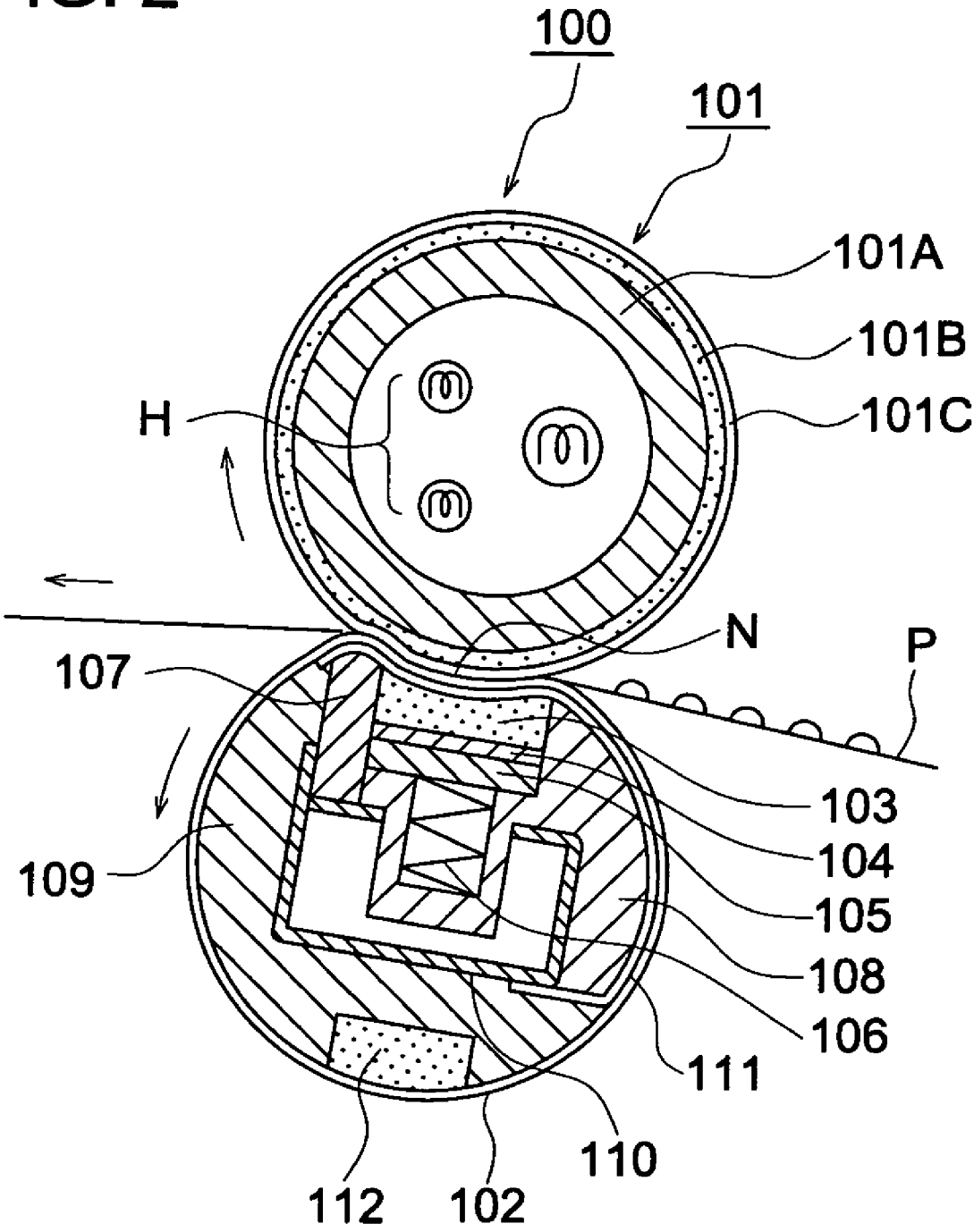
FIG. 2 is a cross-sectional diagram in a direction at right angles to the longitudinal direction of the fixing device.

Next, a preferred embodiment of the main constitution of a fixing device 100 of the present invention is explained referring to FIG. 2. FIG. 2 is a cross-sectional diagram in a direction at right angles to the longitudinal direction of the fixing device.

The fixing roller 101 has a halogen lamp (heating member) built in at the its center, and is constituted from a cylindrical shaped core metal 101A formed from aluminum, iron, etc., an elastic layer 101B made of silicone rubber with a high thermal resistance and covering the core metal 101A, and in addition, a releasing layer 101C made of a fluoroplastic such as perfluoroalkoxy (herein after abbreviated as PFA) or polytetrafluoroethylene (hereinafter abbreviated as PTFE).

The fixing belt 102 is constituted from a base formed by polyimide with a thickness of about 100 μm and a releasing layer within a thickness of about 25 μm made of PFA or PTFE covering the outside surface of the base, and is formed in an endless shape. Further, since the figure becomes unclear if a base and releasing layer are written for the thin fixing belt 102, they have been omitted.

The pressure pad 103, as a pressure member, is formed from a silicone rubber that is softer than the elastic layer 101B and is held by a holder 108 made of a heat resistant plastic along with a metal base plate 104 made of stainless steel and a base member 105 made of a heat resistant plastic. Further, a compression spring 106 is provided for the base member 105. The pressing section corresponds to the pressing pad 103, the metal base plate 104, the base member 105, and the compression spring 106.

The separating member 107 is placed on the downstream side of the direction of conveying the recording sheet P in order to increase the separation characteristics of the fixed recording sheet P. The leading edge part of the separating member is formed in the shape of an arc with a large curvature using a heat resistant plastic or a metal such as aluminum, and is held by a holder 109 made of a heat resistant plastic via a metal base plate 104, etc., and a metal frame 110. The separating section corresponds to the separating member 107.

Further, the holders 108 and 109 are held by a frame 110 placed at the center. The holding section corresponds to the holders 108 and 109 and the frame 110.

The sliding sheet 111 is made of a Teflon® coated glass fiber sheet or PTFE sheet and is placed between the inner peripheral surface of the fixing belt 102 and the pressure pad 103 and between the inner peripheral surface of the fixing belt 102 and the separating member 107, and one of its ends is fixed to the holder 109.

The oil pad 112 (the lubricating agent supplying section) formed from a sponge, etc., contains a lubricating agent such as a silicone oil, etc., is held by the holder 109 and is in pressure contact with the inner peripheral surface of the fixing belt 102.

Further, the holder 109 also has the function of a guiding member that guides the fixing belt 102 during the rotation of the fixing belt 102.

In a fixing device 100 constituted in this manner, the fixing roller, which is heated by a halogen lamp H and driven by a driving section not shown in the figure, rotates in the clockwise direction. Also, the pressure pad 103 is pressed by the compression spring via the metal base plate 104 and the base member 105, and presses the fixing belt 102 from its inner peripheral surface via the sliding sheet 111 and presses it against the fixing roller 101.

Therefore, the fixing belt 102 rotates in the anticlockwise direction due to the rotation of the fixing roller 101, and since it is elastically deformed in a concave shape along with the pressure pad 103 due to being pressed against the fixing roller 101, a wide nip portion N is formed between the fixing belt 102 and the fixing roller 101. Thus, the conveyed recording sheet P is gripped and pressed in the nip portion N, and the unfixed toner on the recording sheet P is fixed by the application of heat and pressure.

Further, while the inner peripheral surface of the fixing belt 102 slides against the sliding sheet 111 around the nip portion N, since the sliding sheet is formed of a material with a small coefficient of friction, the sliding resistance between the two is small. In addition, since a silicone oil, etc., is supplied to the inner peripheral surface of the fixing belt 102 as a lubricating agent from the oil pad 112, the sliding resistance becomes even smaller.

Further, the separating member 107 presses the fixing belt 102 against the fixing roller 101 via the sliding sheet 111 and causes the elastic layer 101B and the releasing layer 101C of the fixing roller to get elastically deformed in a concave shape with a large curvature. Therefore, the recording sheet P fixed in the nip portion N definitely gets peeled off and separated from the fixing roller 101 without having to use a separating claw, etc.

As explained above, although the sliding resistance between the fixing belt 102 and the sliding sheet 111 is small, even then some abrasion occurs in both of them due to use for a long time. When such abrasion occurs, the sliding resistance increases, due to which the load of the motor driving the fixing roller 101 increases, and the power consumption increases. In addition, if a shift occurs in the fixing belt 102 due to increased sliding resistance, a shift occurs also in the fixed image.

In view of this, to begin with, the present inventors paid attention to the combination of the materials of the fixing belt 102, and carried out experiments for comparing the sliding torque when the materials of the two are changed.

a. Experiment Conditions

Fixing device: Configuration shown in FIG. 2

Fixing belt: Three type of PTFE coating or PFA tubing provided as the releasing layer on the inner peripheral surface of a PI base member, and PI base member itself, all of which were processed to have a surface roughness of Ra 0.5 of the inner peripheral surface.

Sliding sheet: A sheet with PTFE coating on the outer surface (the surface on the side of the fixing belt) of a glass cloth or PFA sheet, Chuko Kasei FGF400 (product name).

Lubricating agent: Dimethyl silicone oil (1000 cs)

Nip portion: Total pressure 350N, nipping width 11 mm

Linear speed: 300 mm/sec

Control temperature: 180° C.

b. Results of Experiments

The results of the experiments are shown in Table 1.

TABLE 1

| Material of the inner peripheral surface of the fixing belt | PTFE coating | | PFA tubing | | PI |
|---|---|---|---|---|---|
| Material of the outside surface of the sliding sheet | PTFE coating | PFA sheet | PTFE coating | PFA sheet | PTFE coating |
| Sliding torque (kg-cm) | 3.5 | 4.0 | 4.2 | 4.7 | 5.0 |

c. Study

The sliding torque was the smallest when PTFE coating was given on the inner peripheral surface of the fixing belt and PTFE coating was given on the outside surface of the sliding sheet.

However, even if the torque during siding is made the smallest by forming both the fixing belt and the sliding sheet from PTFE, it is not possible to avoid a certain amount of abrasion of the fixing belt and the sliding sheet. In view of this, in order to reduce the abrasion further, the present inventors paid attention to the surface hardness of the fixing belt and the sliding sheet, and carried out measurement of the abrasion ratio of PTFE of the sliding sheet in the nip portion under the above experiment conditions while changing the combinations of the surface hardness of the sliding sheet and the fixing belt.

The results are shown in Table 2.

TABLE 2

| | | | |
|---|---|---|---|
| Hardness of the inner peripheral surface of fixing belt (H1) (degrees) | 60 | 75 | 90 |
| Hardness of the outside surface of sliding sheet (H2) (degrees) | 75 | 75 | 75 |
| Abrasion ratio of nip portion | 95 | 85 | 60 |

Further, the surface hardness was measured according to JIS-A.

Further, the abrasion ratio of the nip portion is the abrasion ratio of the sliding sheet after sliding for 100 hours, and when the mass of the PTFE before starting the experiment is taken as 100, it is a ratio of the mass of PTFE after being lost due to abrade to the mass of the PTFE before being lost. In other words, taking the total mass of the sliding sheet before starting the experiment as A, and product (thickness of PTFE× area×specific weight) before starting the experiment as B, then A-B is taken as the mass C of the base material. In addition, the total mass of the sliding sheet after the experiment is taken as D. Consequently, the abrasion ratio is obtained using the following equation.

$$(D-C)/(A-C)$$

According to the experiment of Table 2, it has been found that the abrasion of the sliding sheet increased when the surface hardness (H2) of the outside surface of the sliding sheet on the side of the fixing belt was lower than the surface hardness (H1) of the inner peripheral surface of the fixing belt, and that the abrasion of the sliding sheet decreased when the surface hardness (H2) of the outside surface of the sliding sheet on the side of the fixing belt was equal to or higher than the surface hardness (H1) of the inner peripheral surface of the fixing belt. Especially, the abrasion of PTFE of the sliding sheet was the smallest when the surface hardness (H2) of the outside surface of the sliding sheet which is the surface of the sliding sheet facing to the fixing belt was higher than the surface hardness (H1) of the inner peripheral surface of the fixing belt.

This can be assumed to be due to the following reason. That is, since even both the sliding sheet and the fixing belt are made of PTFE, the abrasion of the surface of the sliding sheet increases as the surface of the sliding sheet is relatively soft when the surface hardness (H2) of the outside surface of the sliding sheet on the side of the fixing belt is lower than the surface hardness (H1) of the inner peripheral surface of the fixing belt. Consequently, it becomes difficult for the nip portion to hold the lubricating agent.

The abrasion of the surface of the sliding sheet decreases as the physical properties of the two become the same when the surface hardness (H2) of the outside surface of the sliding sheet on the side of the fixing belt are equal to the surface hardness (H1) of the inner peripheral surface of the fixing belt. Consequently, this can increase the efficiency to hold the lubricating agent in the nip portion compared with the above mentioned condition. However the sliding surface of the fixing belt has a far larger sliding surface compared with the sliding sheet, the load to the sliding sheet becomes larger, and it first results in a loss at the surface of the PTFE coating of the sliding sheet. Once the loss has resulted, the loss increases exponentially and it can be assumed that the abrasion of the PTFE coating of sliding sheet easily increases compared with the fixing belt.

On the other hand, when the fixing belt has a lower hardness of the surface compared with the sliding sheet, since the sliding surface of the fixing belt is far larger than that of the sliding sheet, the amount of abrasion per unit area is small. On the other hand, since the sliding sheet has a higher surface hardness, it is hard to abrasion, and as a result, the surface roughness of the sliding sheet does not change largely. Therefore, overall abrasion of the nip portion becomes small, and durability increases and it can hold the lubricating agent for a long time in the nip portion.

Further, a similar effect can also be obtained by selecting an appropriate surface roughness instead of the surface hardness.

The results of experiments carried out under the above conditions while changing the combinations of the surface roughness of the sliding sheet and the fixing belt are shown in Table 3.

TABLE 3

| | | | | | |
|---|---|---|---|---|---|
| Surface roughness of the inner peripheral surface of fixing belt (Ra1) | 0.7 | 0.5 | 0.5 | 0.7 | 0.5 |
| Surface roughness of the outside surface of sliding sheet (Ra2) | 1.0 | 1.0 | 0.5 | 0.5 | 0.1 |
| Sliding torque (kg-cm) | 4.5 | 4.2 | 3.7 | 3.5 | 3.0 |

According to Table 3, the sliding torque was the smallest when the surface roughness (Ra1) of the inner peripheral surface of fixing belt was equal to or larger than the surface roughness (Ra2) of the outside surface of sliding sheet which is the surface of the sliding sheet facing to the fixing belt.

This can be assumed to be due to the following reason. That is, as is shown in FIG. 2, the lubricating agent is supplied from the oil pad 112 to the fixing belt 102, then gets adhered to the fixing belt 102, then is conveyed up to the position of the sliding sheet 111, and then gets adhered to the sliding sheet. At that time, in order for the fixing belt 102 or the sliding sheet 111 to hold the lubricating agent, it is necessary that the inner peripheral surface is formed to have an appropriate surface roughness, that is, it is necessary that undulations are formed on the surfaces. Further, when the lubricating agent is supplied to the fixing belt 102 from the oil pad 112, not only the depressions but also the projections in the fixing belt 102 will be in a state in which they are covered by an oil film.

At this time, in the case in which the surface roughness of the fixing belt 102 is equal to or larger than the surface roughness of the sliding sheet 111, that is, when the difference between the depressions and projections of the fixing belt 102 is equal to or larger than the difference between the depressions and projections of the sliding sheet, at the time that a part of the lubricating agent from the fixing belt 102 moves to and gets adhered to the sliding sheet 111, the amount of that movement will be small, and since the fixing belt and the sliding sheet slide against each other in the condition in which an appropriate quantity of the lubricating agent is adhered to both of them, the sliding torque becomes small. As a result, the durability of the fixing belt 102 and the sliding sheet 111 increases.

On the other hand, in the case in which the surface roughness of the fixing belt 102 is smaller than the surface roughness of the sliding sheet 111, that is, when the difference between the depressions and projections of the fixing belt 102 is smaller than the difference between the depressions and projections of the sliding sheet, at the time that a part of the lubricating agent from the fixing belt 102 moves to and gets adhered to the sliding sheet 111, the amount of that movement becomes relatively large, and since the fixing belt and the sliding sheet slide against each other in the condition in which an insufficient quantity of the lubricating agent is adhered to both of them, the sliding torque does not become small. As a result, the durability of the fixing belt 102 and the sliding sheet 111 becomes insufficient.

Further, in the case that a releasing layer is formed on the base of the fixing belt, the fixing belt becomes unusable when the releasing layer is abraded or pealed off. Therefore the releasing layer is needed to be fixed firmly in a production process so as not to be pealed off. However due to entering the air or extraneous material between the base and the releasing layer, a case that the releasing layer does not sufficiently closely contact the base is caused.

Further, in order to solve the problem such as getting peeled off of the releasing layer made of PTFE in the fixing belt, it is desirable to form the fixing belt with single layer of PTFE.

As the PTFE in this case, it is desirable to use modified PTFE, carbon packed PTFE, polyimide doped PTFE, etc.

Since modified PTFE has superior abrasion resistance, the sliding abrasion becomes small, and also, since it is a plastic having superior tensile elongation and creep resistance, it has the feature of increased durability against repeated deformation of the fixing belt in the nip portion.

Since carbon packed PTFE has superior abrasion resistance, the sliding abrasion becomes small, and also, since it is possible to reduce the electrical resistance, it has the feature that there is no disturbing of the toner image due to charging.

Since polyimide doped PTFE it is a plastic having superior tensile elongation, it has the feature of increased durability against repeated deformation of the fixing belt in the nip portion.

Further, baking is used when manufacturing fixing belts using the above materials.

In addition, even when formed of single layer of PTFE, the relationship with the sliding sheet is the same as that described above.

What is claimed is:

1. A fixing device comprising:

a fixing roller which has an elastic layer and an internal heating member, and rotates;

an endless fixing belt which rotates with the fixing roller;

a pressure member which presses the fixing belt against the fixing roller from an inner peripheral surface side of the fixing belt;

a sliding sheet placed between the fixing belt and the pressure member; and a lubricating agent supplying section which supplies a lubricating agent to the inner peripheral surface of the fixing belt, a toner image being fixed onto a recording media at a nip portion formed between the fixing roller and the fixing belt, wherein the inner peripheral surface of the fixing belt and a surface of the sliding sheet are formed of polytetrafluoroethylene, wherein the following relation is satisfied:

$H1 \leqq H2$, where H1 is a surface hardness of the inner peripheral surface of the fixing belt and H2 is a surface hardness of the sliding sheet facing to the fixing belt.

2. The fixing device of claim 1, wherein the following relation is satisfied:

$$H1<H2.$$

3. The fixing device of claim 1, wherein the fixing belt is formed of single layer of polytetrafluoroethylene.

4. An image forming apparatus comprising the fixing device of claim 1.

5. A fixing device comprising:

a fixing roller which has an elastic layer and an internal heating member, and rotates;

an endless fixing belt which rotates with the fixing roller;

a pressure member which presses the fixing roller against the fixing belt from an inner peripheral surface side of the fixing belt;

a sliding sheet placed between the fixing belt and the pressure member; and a lubricating agent supplying section which supplies a lubricating agent to the inner peripheral surface of the fixing belt, a toner image being fixed onto a recording media at a nip portion formed between the fixing roller and the fixing belt, wherein the inner peripheral surface of the fixing belt and a surface of the sliding sheet are formed of polytetrafluoroethylene, wherein the following relation is satisfied:

$Ra1 \geqq Ra2$, where Ra1 is a surface roughness of the inner peripheral surface of the fixing belt and Ra2 is a surface roughness of the sliding sheet facing to the fixing belt.

6. The fixing device of claim 5, wherein the following relation is satisfied:

$$Ra1>Ra2.$$

7. The fixing device of claim 5, wherein the fixing belt is formed of single layer of polytetrafluoroethylene.

8. An image forming apparatus comprising the fixing device of claim 5.

* * * * *